US009157443B2

(12) United States Patent
Tsutsui

(10) Patent No.: US 9,157,443 B2
(45) Date of Patent: Oct. 13, 2015

(54) TURBO MOLECULAR PUMP DEVICE

(71) Applicant: Shingo Tsutsui, Kyoto (JP)

(72) Inventor: Shingo Tsutsui, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 550 days.

(21) Appl. No.: 13/625,884

(22) Filed: Sep. 25, 2012

(65) Prior Publication Data

US 2013/0115074 A1 May 9, 2013

(30) Foreign Application Priority Data

Nov. 9, 2011 (JP) ..... 2011-245437

(51) Int. Cl.

| | |
|---|---|
| ***F04D 19/04*** | (2006.01) |
| ***F04D 25/06*** | (2006.01) |
| ***F04D 29/52*** | (2006.01) |
| ***F04D 29/60*** | (2006.01) |

(52) U.S. Cl.

CPC ..... *F04D 19/042* (2013.01); *F04D 25/068* (2013.01); *F04D 29/522* (2013.01); *F04D 29/601* (2013.01)

(58) Field of Classification Search

CPC ..... F04D 29/04; F04D 29/042; F04D 29/044; F04D 29/046; F04D 25/12; F04D 29/40; F04D 29/403; F04D 29/52; F04D 29/522; F04D 29/601; F04D 29/644; F05B 2260/30; F05B 2260/301; F05B 2260/3011

See application file for complete search history.

(56) References Cited

U.S. PATENT DOCUMENTS

| | | | | |
|---|---|---|---|---|
| 2003/0095862 | A1* | 5/2003 | Kawanishi et al. | 415/90 |
| 2005/0249618 | A1* | 11/2005 | Nonaka et al. | 417/423.4 |
| 2007/0237650 | A1* | 10/2007 | Birkenstock et al. | 417/42 |
| 2009/0208354 | A1* | 8/2009 | Crisi et al. | 417/423.4 |
| 2010/0215475 | A1* | 8/2010 | Brewster et al. | 415/90 |

FOREIGN PATENT DOCUMENTS

| | | |
|---|---|---|
| JP | 2003-148380 | 5/2003 |
| JP | 2010-236469 | 10/2010 |
| JP | 2011-169165 | 9/2011 |
| WO | 2008096622 | 8/2008 |

* cited by examiner

*Primary Examiner* — Igor Kershteyn
(74) *Attorney, Agent, or Firm* — Jianq Chyun IP Office

(57) ABSTRACT

A control unit, which is integrally mounted on a turbo molecular pump, is provided, in which the control unit can be miniaturized or the manufacturing costs are reduced. An upper casing (12) is fastened on a first mounting member (91) of an external device through a fastening member (61) inserted in a through hole (51) of a flange plate (12*a*). A first base (14) fastened on the upper casing (12) is fastened on a second mounting member (92) of the external device through a fastening member (63) inserted in a through hole (52) of a flange plate (14*b*). A control unit (70) is fastened on a second base (15) through a fastening member (65). Since torque produced when a rotor (30) is damaged is not asserted to the fastening member (65), strength of the fastening member (65) and a casing of the control unit (70) is small.

5 Claims, 3 Drawing Sheets

TURBO MOLECULAR PUMP DEVICE

CROSS-REFERENCE TO RELATED APPLICATION

This application claims the priority benefit of Japan application serial no. 2011-245437, filed on Nov. 9, 2011. The entirety of the above-mentioned patent application is hereby incorporated by reference herein and made a part of this specification.

BACKGROUND OF THE INVENTION

1. Field of the Invention

The present invention relates to a turbo molecular pump device.

2. Description of Related Art

A turbo molecular pump device is mounted in manufacturing devices for manufacturing semiconductor devices or liquid crystals, and a built-in rotor thereof is rotated in high speed, so that gas molecules are taken in from an air inlet and exhausted from an air outlet, thus a high vacuum is created in the manufacturing device. The turbo molecular pump device has a control unit (a power supply device) which drives and controls the turbo molecular pump, and the control unit is integrally formed and fixed on the turbo molecular pump with the built-in rotor by using a fastening member. If the control unit and the turbo molecular pump are integrated, the guiding of a cable connected to a motor or a magnetic bearing of the turbo molecular pump becomes simple; thereby, the efficiency of the connection operation is improved. Therefore, the turbo molecular pump device integrating a turbo molecular pump and a control unit is preferably applied to a large manufacturing device requiring a plurality of turbo molecular pump devices.

Since the rotor of the turbo molecular pump rotates in high speed, the rotor may be damaged due to factors such as interference. If the rotor is damaged, fragments of the rotor may strike a casing member, bringing great damaging torque (emergency stop torque) to the casing member. A flange plate is disposed at a circumferential portion of the air inlet of the turbo molecular pump. The flange plate is fastened on a manufacturing device by using a fastening member, so that the turbo molecular pump is fixed on the manufacturing device.

The control unit is fastened by using a fastening member and fixed on the turbo molecular pump fixed on the manufacturing device. If the rotor is damaged, the damaging torque applied by fragments of the rotor to the casing member may also be transferred to the control unit.

To enhance the strength of the fastening member used to fasten the control unit and the turbo molecular pump to sufficiently endure the damaging torque, the size of the fastening member must be greater, which enlarges the size of the control unit.

Therefore, in a conventional turbo molecular pump device, an octagonal annular recessed portion is formed on the bottom surface of the casing of the turbo molecular pump, and an annular protruding portion engaged with the annular recessed portion is disposed on a casing of the control unit (for example, referring to Japanese Laid-open Patent Publication No. 2010-236469). In the above-mentioned turbo molecular pump device, the two casings absorb the damaging torque through the contact of corner portions of the annular recessed portion and the annular protruding portion.

In a structure in which a control unit is fastened on a turbo molecular pump, damaging torque of a rotor may be transferred to the control unit. Therefore, as shown in the Japanese Laid-open Patent Publication No. 2010-236469, in the structure in which casings of the turbo molecular pump and the control unit are used to absorb the damaging torque of the rotor, the casing of the control unit must have the strength capable of enduring the damaging torque. Therefore, a wall thickness of the casing of the control unit must be increased or a material with greater strength is used to form the casing, which may be the main contributing factor to a large-sized device or heightened manufacturing costs.

SUMMARY OF THE INVENTION

Features of a turbo molecular pump device according to the present invention include: a turbo molecular pump including a casing member and a rotor which is accommodated in the casing member, so as to transport gas molecules from an air inlet to an air outlet of the casing member through high speed rotation of the rotor; and a control unit driving and controlling the turbo molecular pump. A first mounting portion and a second mounting portion are formed in the casing member, wherein the first mounting portion for an external device mounted thereon is disposed at a side of the air inlet, and the second mounting portion for an external device mounted thereon is disposed at a side of the air outlet, and the turbo molecular pump and the control unit are fixed through fastening members. The external device where the first mounting portion is mounted and the external device where the second mounting portion is mounted may be the same external device or may be respectively different external device.

Effects of the Invention

According to the exemplary embodiments of the present invention, damaging torque applied to the casing member is transferred from the first mounting portion and the second mounting portion of the casing member to external devices. Therefore, the strength of fastening members for fastening a turbo molecular pump and a control unit as well as that of the casing of the control unit may be decreased, hence, the control unit may be miniaturized and/or the manufacturing costs is may be reduced.

BRIEF DESCRIPTION OF THE DRAWINGS

The accompanying drawings are included to provide a further understanding of the invention, and are incorporated in and constitute a member of this specification. The drawings illustrate embodiments of the invention and, together with the description, serve to explain the principles of the invention.

DESCRIPTION OF THE EMBODIMENTS

Figure 1:
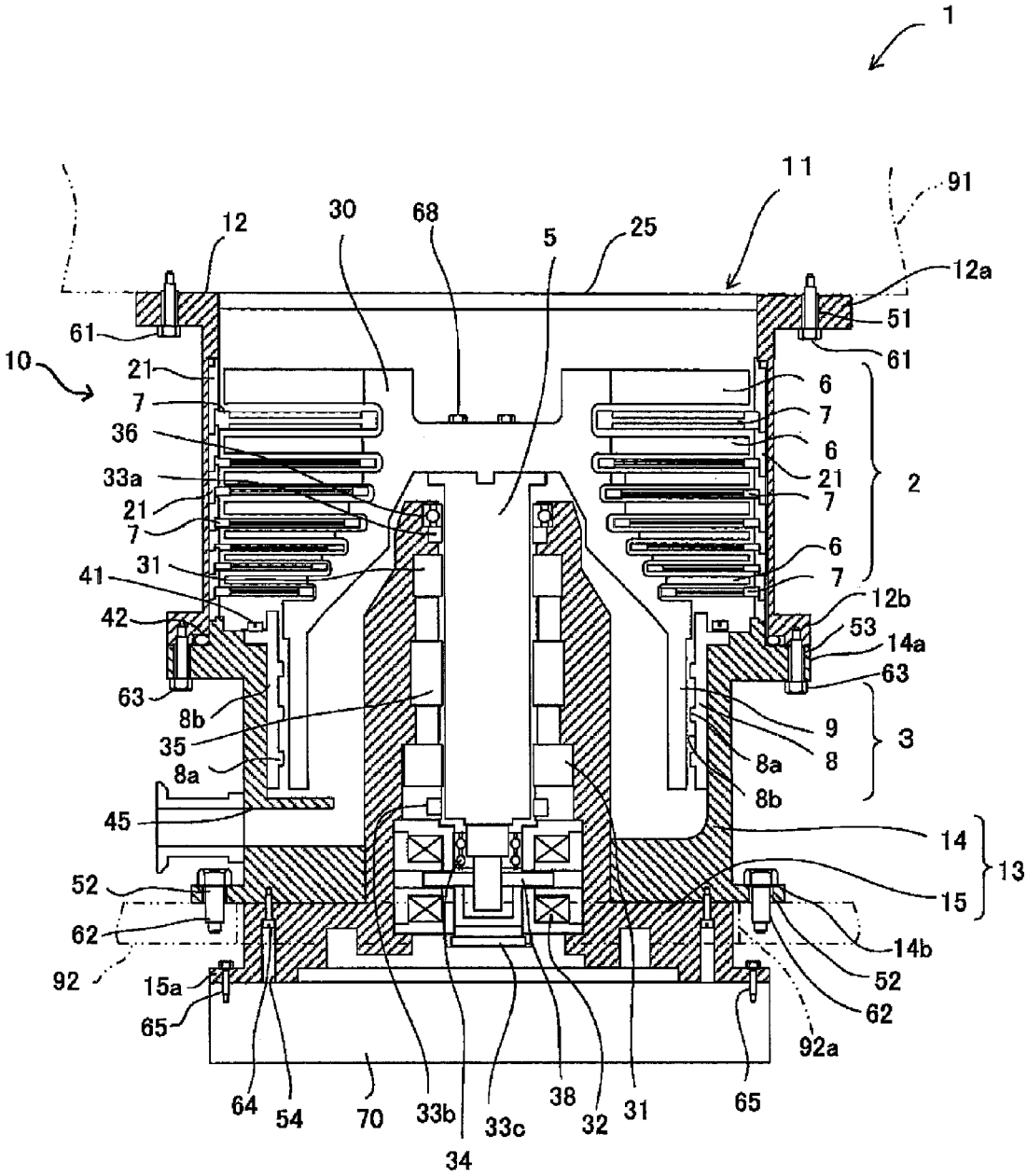
FIG. 1 is a schematic cross-sectional view of a turbo molecular pump device according to an exemplary embodiment of the present invention.

Reference will now be made in detail to the present embodiments of the invention, examples of which are illustrated in the accompanying drawings. Wherever possible, the same reference numbers are used in the drawings and the description to refer to the same or like parts.

Embodiment 1

An embodiment of a turbo molecular pump device according to the present invention is described in the following with reference to the accompanying drawings.

FIG. 1 is a schematic cross-sectional view of the turbo molecular pump device according to an embodiment of the present invention.

The turbo molecular pump device 1 shown in FIG. 1 includes a turbo molecular pump 10, and a control unit 70 mounted at a bottom of the turbo molecular pump 10.

The turbo molecular pump 10 includes a casing member 11 consisting of an upper casing 12 and a base 13. The upper casing 12 and the base 13 are fixed in close contact and externally sealed through a sealing member 42.

A rotor shaft 5 is disposed at a central axis of the casing member 11. A rotor 30 which is mounted to be coaxial with the rotor shaft 5 is disposed on the rotor shaft 5. The rotor shaft 5 and the rotor 30 are fixed firmly through a fastening member 68 such as bolts.

The rotor shaft 5 is supported in a non-contact manner through magnetic bearings 31 (two parts) in the radial direction and magnetic bearings 32 (an upper and lower pair) in a thrust direction. A levitation position of the rotor shaft 5 is detected through radial displacement sensors 33*a* and 33*b*, and a thrust displacement sensor 33*c*. The rotor shaft 5 which is magnetically levitated and rotates freely through the magnetic bearings 31 and 32 is driven by a motor 35 in high speed rotation.

A rotor disc 38 is mounted under the rotor shaft 5, via the mechanical bearing 34. Furthermore, mechanical bearing 36 is disposed at an upper side of the rotor shaft 5. The mechanical bearings 34 and 36 are mechanical bearings used in emergency, wherein the mechanical bearings 34 and 36 are used for supporting the rotor shaft 5 when the magnetic bearings 31 and 32 are idle.

The rotor 30 has a two-section structure including an upper side and a lower side, and multi-stage rotor vanes 6 are disposed at the upper side. The lower part starting from the lowest-stage rotor vane 6 is set as a lower section side, and a rotor cylinder portion 9 is disposed at the lower section side.

The upper side of the rotor 30 is covered by the upper casing 12. Stator vanes 7 and spacing pieces 21 are alternately disposed at an inner surface corresponding to the upper side of the rotor 30 of the upper casing 12. The annular spacing pieces 21 are sandwiched between the rotor vanes 6 and the stator vanes 7, and the rotor vanes 6 and the stator vanes 7 form laminations alternately along an axial direction of the pump. On the inner surface of the upper casing 12, if the spacing pieces 21 and the stator vanes 7 are laminated alternately on an upper surface of the base 13 and the upper casing 12 is covered on the top and fixed on the base 13, the rotor vanes 6 and the stator vanes 7 are disposed alternately along the axial direction of the pump.

At an outer circumference side of the rotor cylinder portion 9 of the rotor 30, an annular bolt stator 8 is fixed on the base 13 by using a bolt 41. The bolt stator 8 has spiral protruding portions 8*a*, and a bolt groove portion 8*b* is formed between the spiral protruding portions 8*a*. A gap is disposed between an outer circumference surface of the rotor cylinder portion 9 of the rotor 30 and an inner circumference surface of the bolt stator 8, wherein the gap is capable of transporting gas molecules from an upper part to a lower part when the rotor 30 rotates in high speed.

An air inlet 25 is disposed on an upper surface of the upper casing 12.

An air outlet 45 is disposed on the base 13, and the air outlet 45 is connected to a back pump. The rotor 30 is levitated magnetically and in this status the rotor 30 is driven by using the motor 35 in high speed rotation; thereby, gas molecules at the air inlet 25 are exhausted to the air outlet 45.

In the turbo molecular pump 10, a vane gas exhaust portion 2 is disposed in an inner space of the upper casing 12 and a bolt groove gas exhaust portion 3 is disposed in an inner space of the base 13. The vane gas exhaust portion 2 is formed of multiple rotor vanes 6 and multiple stator vanes 7, and the bolt groove gas exhaust portion 3 is formed of the rotor cylinder portion 9 and the bolt stator 8.

If the rotor 30 is driven by the motor 35 in rotation, gas molecules in a vacuum chamber of external devices such as a semiconductor manufacturing device flow in from the air inlet 25. In the vane gas exhaust portion 2, the gas molecules flowing in from the air inlet 25 are splashed to a downstream side. Although not shown, inclination directions of vanes of the rotor vanes 6 and the stator vanes 7 are opposite to each other, and the inclination angle becomes an angle at which gas molecules flow from a high vacuum side, that is, a front section side, to a downstream side, that is, a back section side, but it is difficult for the gas molecules to flow backward. After being compressed in the vane gas exhaust portion 2, the gas molecules are transported to the bolt groove gas exhaust portion 3 in the lower part shown in the figure.

In the bolt groove gas exhaust portion 3, if the rotor cylinder portion 9 rotates in high speed against the bolt stator 8, a gas exhaust function is generated according to the viscous flow. In this manner, the gas transported from the vane gas exhaust portion 2 to the bolt groove gas exhaust portion 3 is compressed and transported to the air outlet 45 and exhausted.

The base 13 includes a first base 14 and a second base 15. The first base 14 is fixed on the upper casing 12, and the second base 15 is fixed on the first base 14.

The first base 14 has a substantially cylindrical shape surrounding the outer circumference of the bolt stator 8, and has a through hole at a central portion of a bottom. The second base 15 includes a cylindrical portion and a flat portion, and has a section substantially in the shape of an inverted T. The cylindrical portion has a hollow portion accommodating the rotor shaft 5, the motor 35, the magnetic bearings 31 and 32, the radial and thrust displacement sensors 33*a* to 33*c*, the mechanical bearings 34 and 36, and the rotor disc 38 which are disposed around the rotor shaft 5, and the flat portion corresponds to the bottom of the first base 14. The cylindrical portion of the second base 15 passes through the through hole at the central portion of the bottom of the first base 14 and is disposed in a space between the rotor shaft 5 and the rotor cylinder portion 9.

The center of the first base 14 and the center of the cylindrical portion of the second base 15 are coaxial with the center of the rotor shaft 5.

In the upper casing 12, a first flange plate 12*a* (a first mounting portion) extending from the circumferential portion to the outer circumference side is formed at the side of the air inlet 25 (namely at the upper portion), and a second flange plate 12*b* extending from the circumferential portion to the outer circumference side is formed at the lower portion. A plurality of through holes 51 is formed on the first flange plate 12*a*. A fastening member 61 such as a bolt is inserted in the through hole 51 of the first flange plate 12*a*, and the fastening member 61 is fastened. In this manner, the upper casing 12 is mounted on a first mounting member 91 of an external device such as a semiconductor manufacturing device shown by a two-dot chain line.

In the first base 14, a third flange plate 14*a* extending from the circumferential portion to the outer circumference side is formed at the upper side, and a fourth flange plate 14*b* extending from the circumferential portion to the outer circumference side is formed at the side of the air outlet side (namely at the lower portion). A plurality of through holes 52 is formed on the fourth flange plate 14*b* (a second mounting portion). A fastening member 62 such as a bolt is inserted in the through hole 52 of the fourth flange plate 14*b*, and the fastening member 62 is fastened. In this manner, the first base 14 is mounted on a second mounting member 92 of an external device, such as a semiconductor manufacturing device shown by two-dot chain lines.

A plurality of through holes 53 is formed on the third flange plate 14*a* of the first base 14. A fastening member 63 such as a bolt is inserted in the through hole 53 of the third flange plate 14*a*, and the fastening member 63 is fastened on a tap (not shown) formed on the upper casing 12. In this manner, the first base 14 and the upper casing 12 are fixed.

A through hole 92*a* is formed in the second mounting member 92. The second base 15 is inserted in the through hole 92*a* of the second mounting member 92.

In the second base 15, a plurality of grooves 54 is formed near the circumferential portion and a fifth flange plate 15*a* extending from the circumferential portion to the outer circumference side is formed at the lower side. A fastening member 64 such as a bolt is inserted in the groove 54, and the fastening member 64 is fastened on to a tap (not shown) disposed on the first base 14. In this manner, the second base 15 is mounted on the first base 14.

The control unit 70 is mounted on the second base 15.

A plurality of through holes (not shown) is formed on the fifth flange plate 15*a*, a fastening member 65 such as a bolt is inserted in each through hole, and the fastening member 65 is fastened on to a tap (not shown) formed on the control unit 70. In this manner, the control unit 70 is fixed to the second base 15.

The control unit 70 includes a power supply portion and a control circuit portion (not shown) and a casing accommodating the members.

In the power supply portion, alternate current (AC) power supplied by a primary power supply is converted to direct current (DC) power by using an AC/DC converter. The DC power is transported to the control circuit portion through a three-phase inverter and a DC/DC converter. The control circuit portion of the control unit 70 is connected, through connectors and cables (not shown), to the motor 35 and the magnetic bearings 31 and 32 in the turbo molecular pump 10; thereby, the motor 35 and the magnetic bearings 31 and 32 are driven and controlled.

In the turbo molecular pump 10, the rotor vane 6 may contact the upper casing 12 or the rotor vane 6 may be damaged due to interference. Due to those primary factors, damaging torque may be applied to the casing member 11. When a crack occurs on the rotor cylinder portion 9, the crack is transferred to the rotor vane 6 and it may induce damage to the rotor cylinder portion 9 and the rotor vane 6; thus, the damaging torque (emergency stop torque) becomes a large value when fragments of the members strike the casing member 11.

If the rotor cylinder portion 9 and the rotor vane 6 are damaged, the damaged fragments may cause an impact to the casing member 11, so that the impact in the rotation direction of the fragments is transferred to the casing member 11. Therefore, the torque corresponding to momentum of the fragments is applied to the casing member 11.

In general, the turbo molecular pump 10 is only mounted on an external device through the first flange plate 12*a* (the first mounting portion) of the upper casing 12, and the control unit 70 is only fastened on the base of the turbo molecular pump.

Therefore, the torque produced on the casing member 11 when the rotor is damaged is applied to the first mounting portion fastened on the external device and is also applied to the mounting portion of the control unit.

Therefore, when only a fastening member is used to mount the casing member 11 and the casing of the control unit 70, the strength of the fastening member must be capable of enduring the strength of the shearing force applied by the torque on the casing member 11 when the rotor is damaged. Therefore, the size of the fastening member becomes larger, and accordingly the size of the control unit becomes larger.

If the mounting of the casing member 11 and the casing of the control unit is designed as a structure described in Japanese Laid-open Patent Publication No. 2010-236469 in which an octagonal annular recessed portion and an annular protruding portion engaged with the annular recessed portion are disposed in one and the other, the structure becomes complicated and the assembly is tedious.

Furthermore, in any case in which a fastening member is used to mount the casing member 11 and the casing of the control unit 70 and the engaging portions of the two casings are polygons, the torque produced and applied to the casing member 11 when the rotor is damaged is always transferred to the casing of the control unit 70. Therefore, the casing of the control unit 70 must have the strength capable of enduring the torque produced when the rotor is damaged. Therefore, a wall thickness of the casing of the control unit 70 must be increased or a material which is more expensive but has greater strength is used, and these are the main contributing factors to a larger-sized apparatus or higher manufacturing costs.

Compared with this, in the turbo molecular pump device 1 according to an embodiment of the present invention, the first flange plate 12*a* (the first mounting portion) of the upper casing 12 is mounted on the first mounting member 91 of the external device, and the fourth flange plate 14*b* (the second mounting portion) of the first base 14 is mounted on the second mounting member 92 of the external device. The upper casing 12 and the first base 14 are fixed at the third flange plate 14*a* and the fourth flange plate 14*b*.

In the structure, the impact of the fragments of the rotor 30 which strike the upper casing 12 is transferred mainly along a path: wherein the impact is transferred to the upper casing 12 to the fastening members 63 used to fasten the second and third flange plates 12*b* and 14*a*, then to the first base 14, then finally to the fastening members 62 used to fasten the fourth flange plate 14*b* and the second mounting member 92 of the external device.

That is, the impact applied by the fragments of the rotor 30 to the casing member 11 is absorbed when transferred from the fastening members 62 used to fasten the fourth flange plate 14*b* and the second mounting member 92 of the external device to the second mounting member 92 of the external device, and therefore is not substantially transferred to the control unit 70.

That is, the torque produced by the impact of the fragments of the rotor 30 and suffered by the casing member 11 is not substantially applied to the fastening member 64 used to fasten the second base 15 on the first base 14 and the fastening member 65 used to fasten the control unit 70 on the second base 15. Therefore, the fastening member 64 just needs to have the strength capable of enduring the total deadweight of the second base 15 and the control unit 70, and the fastening member 65 just needs to have the strength capable of enduring the deadweight of the control unit 70.

Furthermore, since the torque produced by the impact of the fragments of the rotor 30 and suffered by the casing member 11 is not applied to the control unit 70, the casing of the control unit 70 just needs to have the strength at a degree required by the control unit 70 alone.

As an example of a material of the casing of the control unit 70, when the turbo molecular pump and the control unit are different types, the generally used aluminum casting (AC4C) and aluminum die casting material (ADC12) may be used. Furthermore, engineering plastics such as polycarbonate showing high physical properties in impact resistance, heat resistance, and flame retardance may also be used.

In this manner, the strength of the fastening members 64 and 65 may be smaller compared with the prior art, and the casing of the control unit 70 may be a member which features a lower price and a smaller wall thickness.

Therefore, according to an embodiment of the present invention, the control unit 70 may be miniaturized and/or the manufacturing costs may be decreased.

Embodiment 2

Figure 2:
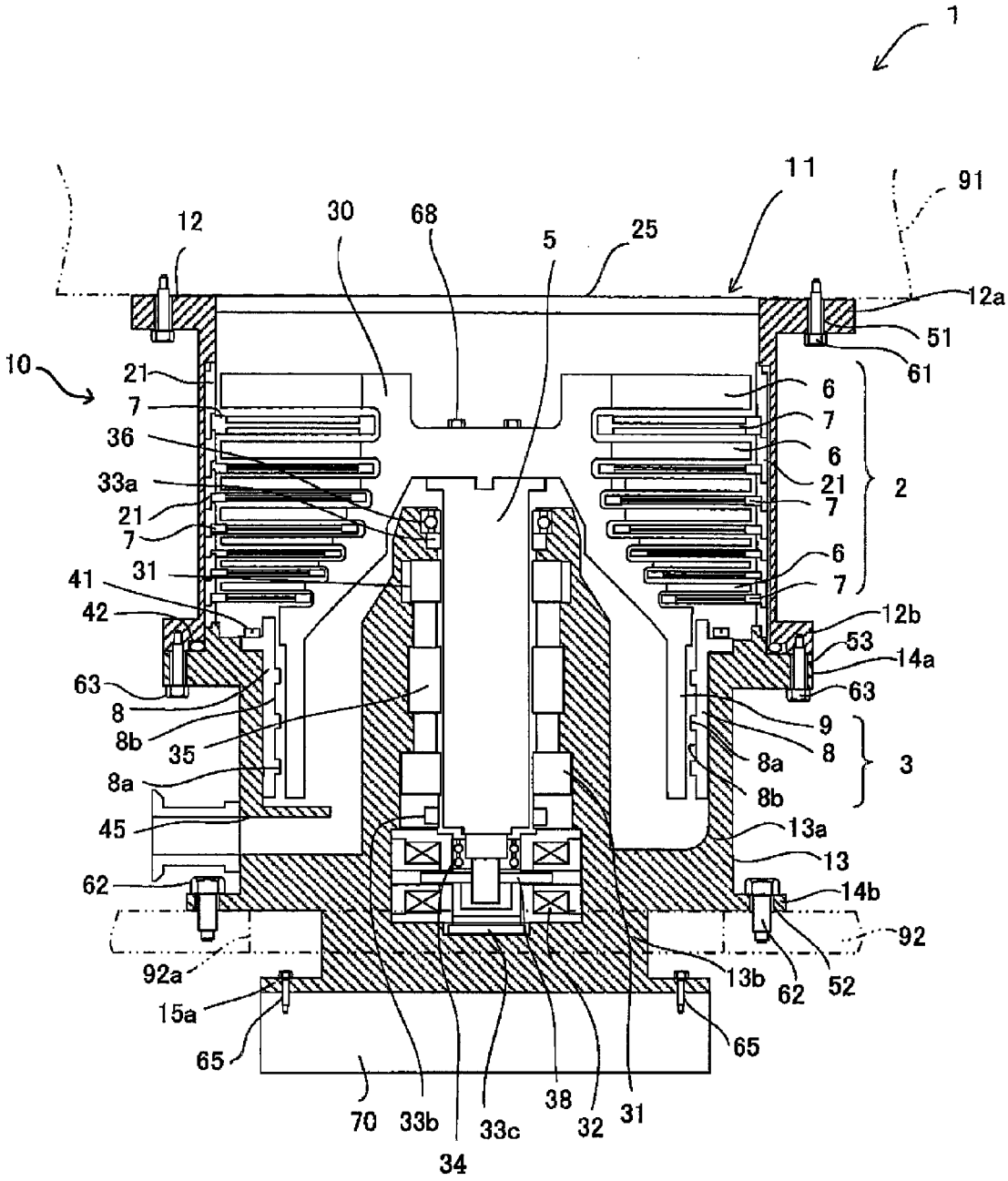
FIG. 2 is a schematic cross-sectional view of a turbo molecular pump device according to the embodiment 2 of the present invention.

FIG. 2 is a schematic cross-sectional view of a turbo molecular pump device according to the embodiment 2 of the present invention.

The difference between the embodiment 2 and the embodiment 1 is that it is assumed that the first base 14 and the second base 15 in the embodiment 1 are integrally formed into a base 13 in the embodiment 2.

In the following, the description focuses on the aspects which are different from those of the embodiment 1. The members which are the same as those in the embodiment 1 are provided with the same reference numerals in the accompanying drawings, and the description thereof is omitted.

That is, the base 13 shown in FIG. 2 includes an upper base portion 13*a* and a lower base portion 13*b*, where the upper base portion 13*a* is formed by connecting a cylindrical portion which is located at a central side and surrounds the outer circumference of a rotor shaft 5 and a motor 35, and a cylindrical portion which is located at a circumferential side and surrounds the outer circumference of a bolt stator 8, and the lower base portion 13*b* is integrally disposed on a lower surface of the upper base portion 13*a*.

A fourth flange plate 14*b* is formed on the upper base portion 13*a*. Similar to that in the embodiment 1, a fastening member 62 is inserted in a through hole 52 formed on the fourth flange plate 14*b*, and the base 13 is fastened on a second mounting member 92 of an external device by using the fastening member 62.

A flange plate 15*a* is formed on the lower base portion 13*b*. Similar to that in the embodiment 1, a fastening member 65 is inserted in a through hole formed on the flange plate 15*a*, and the control unit 70 is fastened on the base 13 by using the fastening member 65.

In the embodiment 2, the impact of the fragments of the rotor 30 which strike the upper casing 12 is transferred mainly along a path: wherein the impact is transferred to the upper casing 12 to the fastening members 63 used to fasten the second and third flange plates 12*b* and 14*a*, and then to the fastening members 62 used to fasten the fourth flange plate 14*b* of the base 13 and the second mounting member 92 of the external device.

In the structure, the impact applied by the fragments of the rotor 30 to the casing member 11 is also absorbed when transferred from the fastening members 62 used to fasten the fourth flange plate 14*b* and the second mounting member 92 of the external device to the second mounting member 92 of the external device, and therefore is not substantially transferred to the control unit 70.

Therefore, the torque produced by the impact of the fragments of the rotor 30 and suffered by the casing member 11 is not substantially applied to the fastening member 65 used to fasten the control unit 70 on the casing member 11. Therefore, the fastening members 65 just need to have the strength capable of enduring the deadweight of the control unit 70.

Furthermore, since the torque produced by the impact of the fragments of the rotor 30 and suffered by the casing member 11 is not applied to the control unit 70, the casing of the control unit 70 just needs to have the strength at a degree required by the control unit 70 alone.

Therefore, similar to that in the embodiment 1, the control unit 70 may be miniaturized and/or the manufacturing costs may be decreased.

Furthermore, since the base 13 is a single member, the assembly may be performed more effectively compared with that in the embodiment 1.

Embodiment 3

Figure 3:
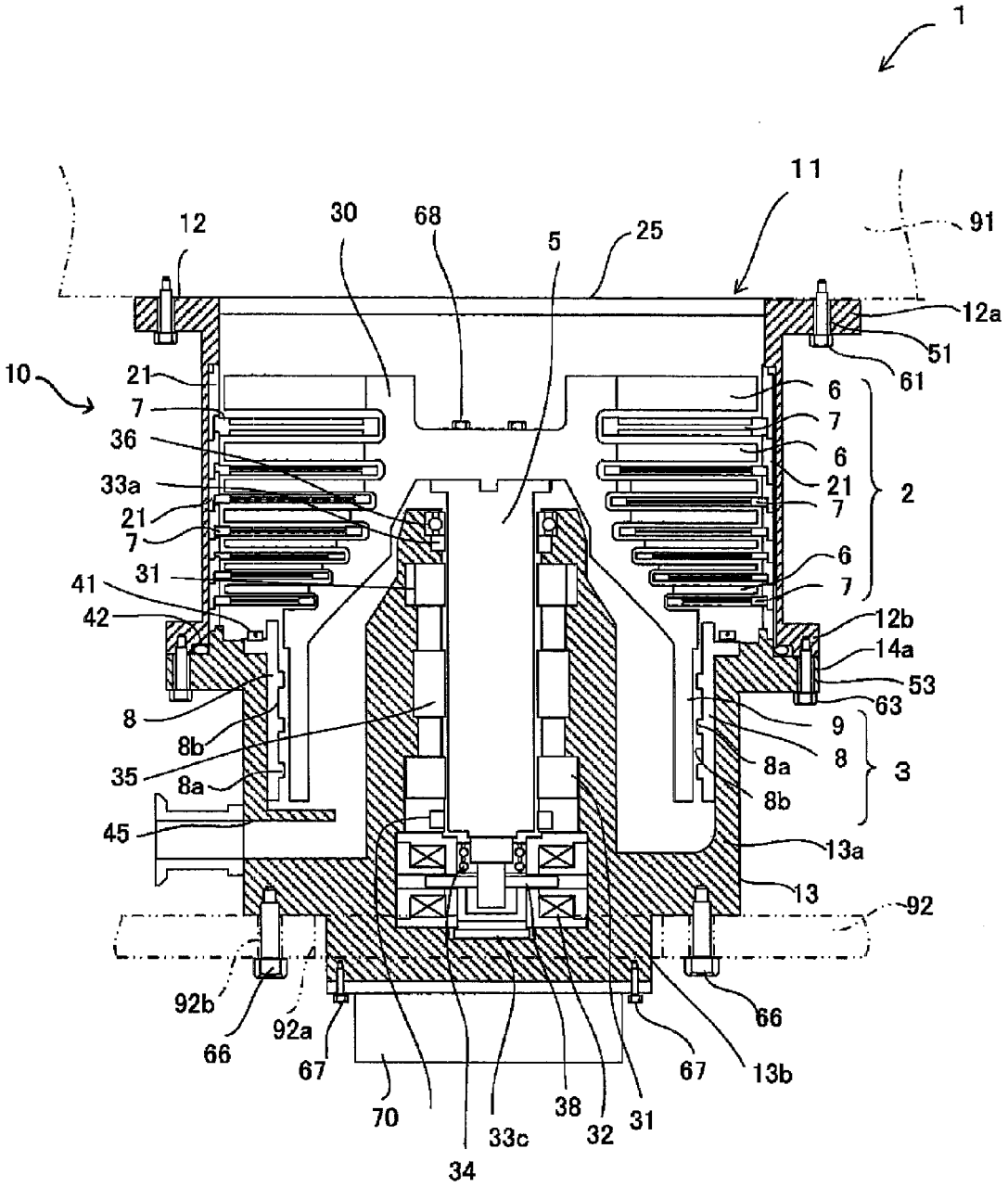
FIG. 3 is a schematic cross-sectional view of a turbo molecular pump device according to the embodiment 3 of the present invention.

FIG. 3 is a schematic cross-sectional view of a turbo molecular pump device according to the embodiment 3 of the present invention.

Similar to the embodiment 1, the embodiment 3 also includes a base 13 integrating a first base 14 and a second base 15. The difference between the embodiment 3 and the embodiment 2 is that in the embodiment 3 there is no fourth flange plate 14*b* formed on the upper base portion 13*a*, as in the embodiment 2.

In the following, the description focuses on the aspects which are different from those of the embodiment 2. The members which are the same as those in the embodiment 2 are provided with the same reference numerals in the accompanying drawings, and the description thereof is omitted.

That is, the base 13 shown in FIG. 3 also includes an upper base portion 13*a* and a lower base portion 13*b*, where the upper base portion 13*a* connects a cylindrical portion which is located at a central side and surrounds the outer circumference of a rotor shaft 5 and a motor 35, and a cylindrical portion which is located at the circumferential side and surrounds the outer circumference of a bolt stator 8, and the lower base portion 13*b* is integrally disposed on a lower surface of the upper base portion 13*a*.

A width of the lower base portion 13*b* is smaller than that of the bottom of the upper base portion 13*a*, and a plurality of taps is formed at the circumferential portion of the bottom of the upper base portion 13*a* (not shown).

In the lower base portion 13*b*, through holes 92*b* corresponding to the taps disposed at the circumferential portion of the bottom of the upper base portion 13*a* are formed around the through hole 92*a* of the second mounting member 92. The lower base portion 13*b* is inserted in the through hole 92*a* of the second mounting member 92, and the fastening members 66 are inserted into through holes 92*b* so as to be fastened on the taps disposed on the upper base portion 13*a*, so that the casing member 11 is mounted on the second mounting member 92 of the external device. The control unit 70 is mounted on the base 13 by fastening the fastening member 67 on a tap (not shown) disposed at a bottom surface of the lower base portion 13*b*.

In the embodiment 3, the impact of the fragments of the rotor 30 which strike the upper casing 12 is transferred mainly along a path: wherein the impact is transferred to the upper casing 12 to the fastening members 63 used to fasten the second and third flange plates 12*b* and 14*a*, and then to the fastening members 66 used to fasten the fourth flange plate 14*b* of the base 13 and the second mounting member 92 of the external device.

In the structure, the impact applied by the fragments of the rotor 30 to the casing member 11 is absorbed when transferred from the fastening members 66 used to fasten the fourth flange plate 14*b* and the second mounting member 92 of the external device to the second mounting member 92 of the external device, and therefore is not substantially transferred to the control unit 70.

Therefore, the torque produced by the impact of the fragments of the rotor 30 and suffered by the casing member 11 is not substantially applied to the fastening member 67 used to fasten the control unit 70 on the casing member 11. Therefore, the fastening member 67 just needs to have the strength capable of enduring the deadweight of control unit 70.

Furthermore, since the torque produced by the impact of the fragments of the rotor 30 and received by the casing member 11 is not applied to the control unit 70, the casing of the control unit 70 just needs to have the strength at a degree required by the control unit 70 alone.

Therefore, similar to that in the embodiment 1, the control unit 70 may be miniaturized and/or the manufacturing costs may be decreased.

Furthermore, similar to that in the embodiment 2, since the base 13 is a single member, the assembly may be performed more effectively compared with that in the embodiment 1.

As described above, according to the embodiments of the turbo molecular pump device provided in the present invention, by disposing the second mounting portion, for being mounted on an external device, on the bases 13 and 14, the torque produced when the rotor 30 is damaged is mainly endured by the fastening members 62 and 66 used to fasten the fourth flange plate 14*b* and the second mounting member 92 of the external device.

That is, a structure is designed in which the torque produced when the rotor 30 is damaged is not applied to the fastening members 64 and 65 used to fasten the control unit 70 on the base 13. In this manner, the strength of the fastening members 64 and 65 may be smaller, and the casing of the control unit 70 may be a member which features a lower price and a smaller wall thickness.

Therefore, the following effects may be achieved: the control unit 70 may be miniaturized and/or the manufacturing costs may be decreased.

Furthermore, in the embodiments, the case in which bolts are used as the fastening members 62 and 66 is described through an example. However, pins may also be used as the fastening members 62 and 66, and the fixing may be performed through pressing or riveting.

Furthermore, in the embodiments, the description about a cooling device for cooling the turbo molecular pump is omitted. Normally, the cooling device is mounted at the lower portion of the base 13, and definitely, the present invention may be applied to a turbo molecular pump device including a cooling device.

Furthermore, variations may be made to the present invention within the scope of the present invention as long as it is a turbo molecular pump device, which includes: a turbo molecular pump which includes a casing member and a rotor which is accommodated in the casing member, so as to transport gas molecules from an air inlet to an air outlet of the casing member through high speed rotation of the rotor; and a control unit driving and controlling the turbo molecular pump, a first mounting portion and a second mounting portion formed in the casing member, wherein the first mounting portion for an external device mounted thereon is disposed at a side of the air inlet, and the second mounting portion for an external device mounted thereon is disposed at a side of the air outlet, and the turbo molecular pump and the control unit are fixed through fastening members.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A turbo molecular pump device, comprising:

a turbo molecular pump, including a casing member and a rotor which is accommodated in the casing member, so as to transport gas molecules from an inlet to an outlet of the casing member through high speed rotation of the rotor; and a control unit, driving and controlling the turbo molecular pump;

wherein a first mounting portion and a second mounting portion are formed in the casing member, the first mounting portion is disposed at a side of the inlet in order for the turbo molecular pump to be mounted on an external device different from the turbo molecular pump, and the second mounting portion is disposed at a side of the outlet in order for the turbo molecular pump to be mounted on an external device different from the turbo molecular pump, and the turbo molecular pump and the control unit are fixed through fastening members.

2. The turbo molecular pump device according to claim 1, wherein the rotor includes a rotor vane and a rotor cylinder portion, the casing member includes an upper casing and a base, the upper casing covers an outer circumference of the rotor vane and a stator vane is disposed at an inner circumference side, the base covers an outer circumference of the rotor cylinder portion and is fastened on the upper casing at a circumferential portion, and the second mounting portion includes a flange plate disposed at the circumferential portion of the base and extends towards an outer circumference side.

3. The turbo molecular pump device according to claim 2, wherein the base includes:

a first base which has the second mounting portion; and a second base which is mounted on the first base and has a mounting portion for mounting the control unit.

4. The turbo molecular pump device according to claim 1, wherein the rotor includes a rotor vane and a rotor cylinder portion, the casing member includes an upper casing and a base, the upper casing covers an outer circumference of the rotor vane and a stator vane is disposed at an inner circumference side, the base covers an outer circumference of the rotor cylinder portion and is fastened on the upper casing at a circumferential portion, and the second mounting portion is disposed at a circumferential portion of the control unit which is at a bottom of the base.

5. The turbo molecular pump device according to claim 1, wherein the second mounting portion is disposed closer to the outlet relative to the first mounting portion and is disposed closer to the inlet relative to the fastening members fixing the turbo molecular pump and the control unit.

* * * * *